US005974968A

United States Patent [19]

Achelpohl et al.

[11] Patent Number: 5,974,968

[45] Date of Patent: Nov. 2, 1999

[54] PRINTING MACHINE

[75] Inventors: Fritz Achelpohl, Lienen; Rainer Jendroska, Greven; Uwe Rogge, Lengerich, all of Germany

[73] Assignee: Windmoeller & Hoelscher, Lengerich/Westf., Germany

[21] Appl. No.: 09/021,822

[22] Filed: Feb. 11, 1998

[30] Foreign Application Priority Data

Feb. 12, 1997 [DE] Germany ..... 197 05 369

[51] Int. Cl.[6] ..... B41F 13/30; B41F 13/44

[52] U.S. Cl. ..... 101/247; 101/352.01

[58] Field of Search ..... 101/247, 216, 101/217, 218, 351.1, 352.01, 352.02, 352.03, 352.04, 352.05, 357, 358, 361, 352.07, 362, 351.3, 351.4, 139, 140, 143, 144, 145, 182, 184, 185

[56] References Cited

U.S. PATENT DOCUMENTS 4,991,503 2/1991 Morner ..... 101/170

5,832,829 6/1997 Kolbe et al. ..... 101/216

FOREIGN PATENT DOCUMENTS 38 25 600 2/1990 Germany .

40 41 497 6/1992 Germany .

195 34 651 3/1997 Germany .

*Primary Examiner*—J. Reed Fisher

*Attorney, Agent, or Firm*—Jacobson, Price, Holman & Stern, PLLC

[57] ABSTRACT

A printing machine, preferably a flexographic printing machine, is provided with at least one counter-pressure cylinder and with at least one printing roller and one engraved roller, whose one end floats in the frame. To intercept the free ends of the printing roller and the engraved roller during the printing operation, the bearing blocks, in which the journals of the free ends of the printing and engraved rollers are supported in the slid-in state, can be moved in guides at right angles to the printing and engraved rollers in the frame.

9 Claims, 2 Drawing Sheets

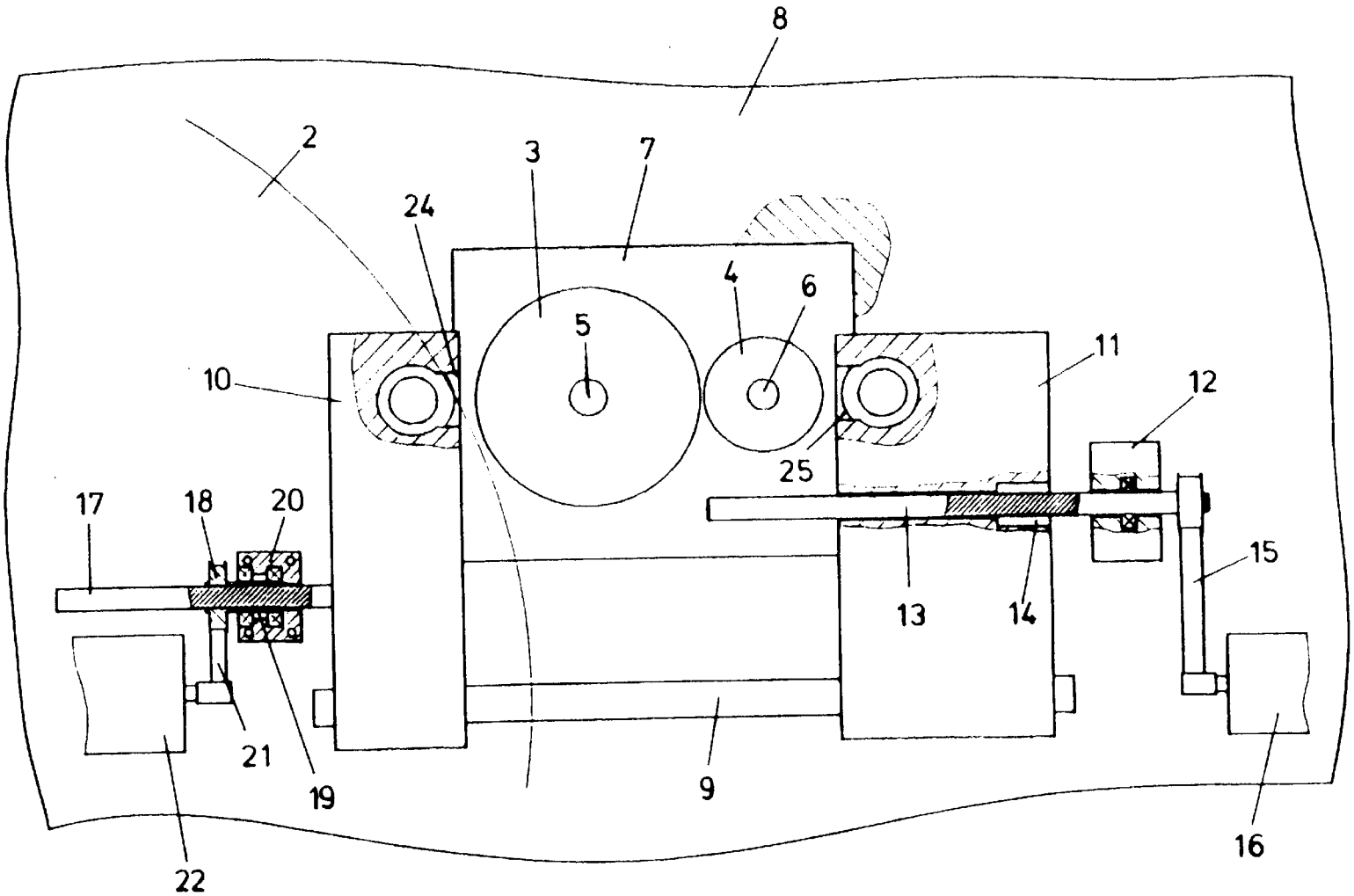
Figur 1

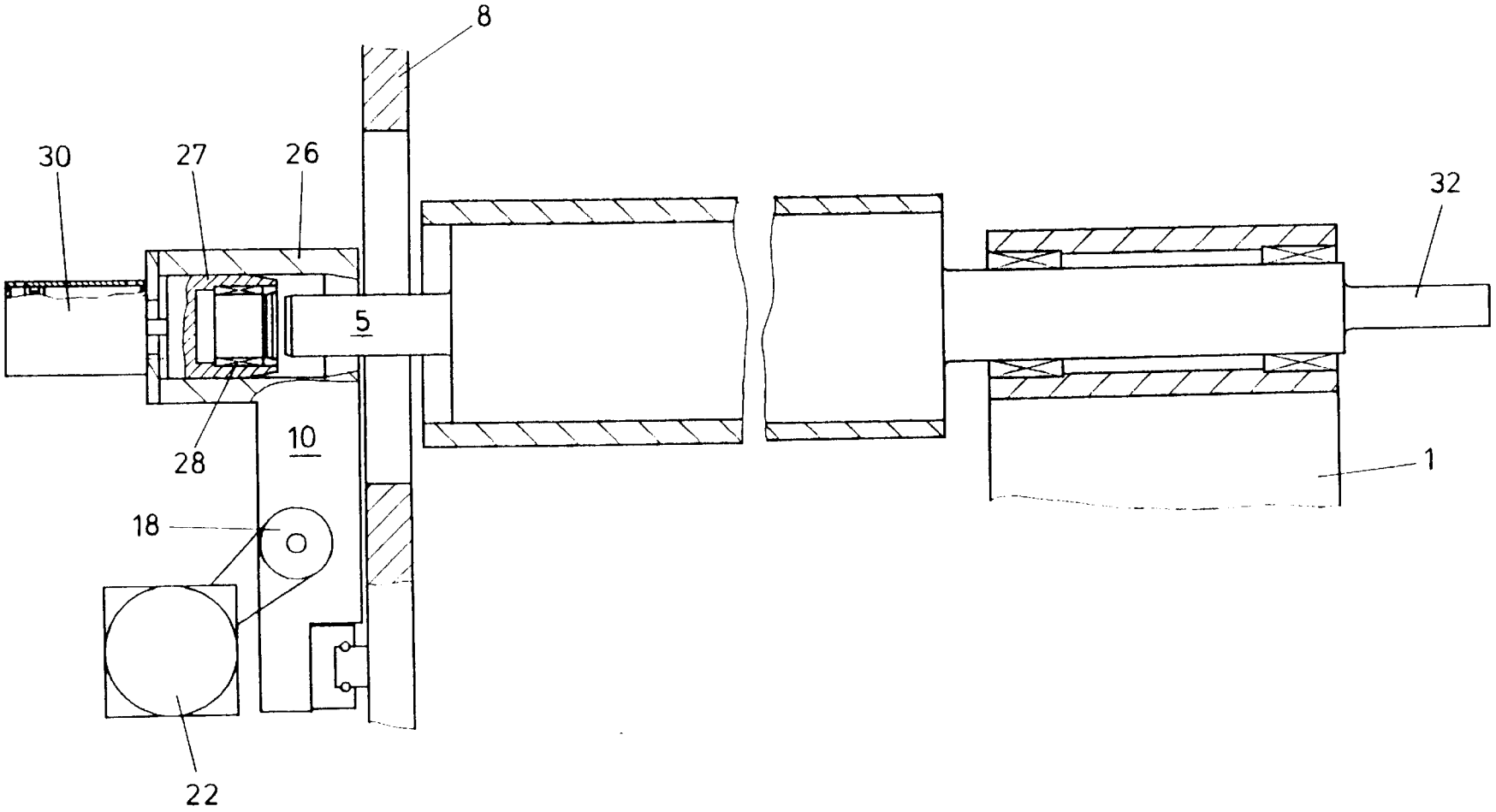
Figur 2

PRINTING MACHINE

In the prior art printing machine mounting the intercepting bearings or attaching the mountings to the bearings, already situated on journals of the printing and engraved rollers, causes certain problems, because the bearings or the mountings are on the inside of a door-like, pivotable plate, so that first the plate itself has to be moved into its locking position and simultaneously or subsequently the mountings or bearings have to be moved into their positions and then adjusted and locked, a feature that cannot be observed from the outside.

Therefore, the object of the invention is to provide a printing machine of the aforementioned type, in which the free ends of the floating printing and engraved rollers can be intercepted in a simpler manner in additional bearings.

The invention solves this problem associated with a printing machine of the type described in the introductory part in that at least one bearing block, in which the journals of the free ends of the printing and engraved rollers are supported in the slid-in state, can be moved in guides at right angles to the printing and engraved rollers in the frame.

In the printing machine, according to the invention, the free ends of the floating printing and engraved rollers can be supported in a simpler manner in additional bearings of the bearing blocks. Because they can be moved in their guides in a precisely defined manner between their positions, which support and release the free ends; and the mountings or bearing mounts can be put on the journals or bearings in a manner that can be readily observed.

To mount the journals of each pair of printing and engraved rollers, a common bearing block can be provided. However, it would be simpler and more straight-forward to provide bearing blocks, which can be moved counter-clockwise, for mounting the journals of each pair of printing and engraved rollers.

Expediently the journals of the free ends of the printing and engraved rollers are in the region of the window-like break-throughs of a side frame. These window-like break-throughs permit, on the one hand, the impression cylinder sleeves to be exchanged in a simple manner and, on the other hand, the guides for the hearing block(s) can be attached to one side of each window-like break-through.

The mounting of the bearing blocks is especially stable when they are guided on both sides of the window-like break-throughs.

The bearings blocks can be moved by means of threaded spindles.

Bearings, which are mounted in the bearing blocks, can be put on the journals.

An especially preferred embodiment provides that the bearing blocks are provided with recesses, which run parallel to their guides and which receive the journals, and with slidable holding heads, which can be slid into a position, which is in alignment with the trunnions, and in said position can be put on said heads. In so doing, the holding heads can already be designed as the journal-supporting bearings.

If the journals comprise roller bearings, only the inner rings are slid on the journals.

If the bearings are already put on the journals of the free ends of the printing and engraved rollers, the holding heads form mountings for the same.

It is expedient to provide the holding heads with mechanisms for sideways adjustment of the bearings.

The holding heads can be moved expediently in the axial direction of the printing and engraved rollers by means of the pressure medium-piston-cylinder unit. In this manner the mountings or the bearings can be slid simply and quickly in the axial direction on the journals.

One embodiment of the invention is explained in detail with reference to the drawings in the following.

FIG. 1 is a top view of a schematic drawing in the axial direction of a pair of printing and engraved rollers, which are located in a window-like break-through of a side section of a frame, and FIG. 2 is a partial cross sectional side view of the device according to FIG. 1.

A counter-pressure cylinder 2, shown only by a part of its circumferential line, and impression cylinders or printing rollers 3, which can be employed at said counter-pressure cylinder, and their assigned engraved rollers 4 are mounted in the conventional manner, which is, therefore, not described in detail, in a printing machine frame 1. Distributed over the circumference of the counter-pressure cylinder 2 are several, for example six, printing mechanisms, which exhibit printing rollers or impressing cylinders 3, which float on moveable carriages, and their assigned engraved rollers 4 with inking mechanisms.

The design of the bearing blocks, which bear the printing rollers and engraved rollers so as to be unsupported, and of the carriages, bearing said bearing blocks, and of the carriage guides and the mechanisms for the fast displacement and precision adjustment of the bearing blocks are known, for example, from the DE-GM 92 08 023 and 92 08 449, to which reference is made for a detailed presentation of the moveable bearings.

The journals 5, 6 of the floating printing and engraved rollers penetrate the rectangular, window-like break-throughs 7 of a side frame 8 of the printing machine frame 1.

A guide rail 9, on which carriage-like bearing blocks 10, 11 can be slid parallel to themselves, is attached to the side frame 8 below the window-like break-through 7 parallel to its bottom edge. The bearing blocks 10, 11 can be slid on the common guide rail 9 by means of worm gears.

To position the journal 6, said journal is slid on the bearing block 11, which is on the right in FIG. 1, by means of a threaded spindle 13, which is freely rotatable, but immoveable in the axial direction and which is mounted in a bracket 12 attached to the front side of the side frame 8, and which penetrates the hearing block 11 in a borehole and is screwed into a nut 14, attached in this borehole. The threaded spindle can be driven over a belt drive 15 by a gear motor 16, attached to the side frame 8.

The bearing blocks can also be driven, as shown with the aid of the left bearing block 10 in FIG. 1 for the impression cylinder 3, by a nonrotatable and axially immoveable threaded spindle 17, which is connected to the bearing block. The threaded spindle 17 is screwed into a pipe, which is provided with an internal thread and whose outer end is provided with a synchronous belt pulley 18. The pipe 19 exhibiting the internal thread can be freely rotated but is axially immoveable in a bracket 20, connected to the side frame 8. The synchronous belt pulley 18 is driven in turn by a synchronous belt 21 by means of the gear motor 22, connected to the side frame 8.

The bearing blocks 10, 11 are provided, on the insides facing each other, with recesses 24, 25, which are parallel to the guide rail 9. The inner ends of these recesses bear guides 26, which run parallel to the journals 5, 6 and in which receiving heads 27 can be slid in the axial direction. These receiving heads are provided with blind holes, in which roller bearings 28 are mounted whose inner rings can be slid on the journals 5, 6. There are pressure medium-piston-cylinder units 30, whose piston rods are connected to the receiving heads 27, for the purpose of sliding the receiving heads 27 with the bearings 28 on the journals 5, 6 and for removal.

The pairs of printing and engraved rollers, distributed over the circumference of the counter-pressure cylinder 2, are provided in the conventional manner with drives, which occur by means of the opposing journals 32.

To remove also the printing and engraved rollers from the counter-pressure cylinder 1, when their free roller ends are supported in the intercepting bearings 28, the guide rails 9 run expediently parallel to the carriages, bearing the printing and engraved rollers, so that the bearing blocks 10, 11 can be moved by suitably controlling the spindles, moving said bearing blocks, by the same amounts as the carriages, bearing the same.

We claim:

1. A printing machine comprising a printing machine frame having a side frame, at least one counter-pressure cylinder, at least one printing roller having two ends and at least one engraved roller having two ends, said at least one printing roller and said at least one engraved roller each having one of said two ends mounted in said printing machine frame, a guide rail located adjacent to said side frame, bearing blocks slidably mounted on said guide rail, a bearing mounted in each of the bearing blocks and supporting the other end of the two ends of the at least one printing roller and supporting the other end of the two ends of the at least one engraved roller, said bearing blocks being movable along said guide rail relative to the counter-pressure cylinder, said bearings in said bearing blocks being quick disconnect bearings for moving towards and away from said respective other end of said at least one printing roller and said at least one engraved roller.

2. The printing machine, as claimed in claim 1, wherein the respective other end of the at least one printing roller and the at least one engraved roller extend through an opening of the side frame.

3. The printing machine, as claimed in claim 2, wherein the bearing blocks are guided on opposite sides of the opening in the side frame.

4. The printing machine, as claimed in claim 1, wherein the bearings blocks are movable by worm gears.

5. The printing machine, as claimed in claim 1, wherein the quick disconnect bearings of the bearing blocks include slidable holding heads mounted in recesses of the bearing blocks.

6. The printing machine, as claimed in claim 5, wherein the holding heads form mountings for the bearings.

7. The printing machine, as claimed in claim 5, wherein the holding heads include mechanisms for sideways adjustment.

8. The printing machine, as claimed in claim 5, wherein the holding heads are moved by a pressure medium-piston-cylinder unit.

9. A flexographic printing machine with one counter-pressure cylinder and at least one inking unit, said flexographic printing machine comprising a printing machine frame having a side frame, a printing roller having two ends and an engraved roller having two ends, one end of the two ends of the printing roller and one end of the two ends of the engraved roller being mounted in said printing machine frame, and a guide rail located adjacent to said side frame, bearing blocks slidably mounted on said guide rail, said bearing blocks being movable at right angles relative to the printing roller and the engraved roller, the bearing blocks include quick disconnect bearings, the other end of the two ends of the printing roller and the other end of the two ends of the engraved roller being supported by said quick disconnect bearings, the bearing blocks including recesses having slidable holding heads, said slidable holding heads being movable towards and away from the other end of said printing roller and said other end of said engraved roller.

* * * * *